US011306885B1

(12) United States Patent
Lopez-Martinez et al.

(10) Patent No.: US 11,306,885 B1
(45) Date of Patent: Apr. 19, 2022

(54) ENCAPSULATED LINEAR LIGHTING WITH CHANNEL

(71) Applicant: Elemental LED, Inc., Reno, NV (US)

(72) Inventors: Gilberto Lopez-Martinez, Reno, NV (US); Brian McKay, Reno, NV (US); Bernard Barcega, Reno, NV (US); Robert Green, Reno, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 17/451,475

(22) Filed: Oct. 19, 2021

(51) Int. Cl.

| | |
|---|---|
| ***F21S 4/28*** | (2016.01) |
| ***F21V 23/00*** | (2015.01) |
| ***F21K 9/90*** | (2016.01) |
| ***F21V 23/06*** | (2006.01) |
| ***F21Y 103/10*** | (2016.01) |
| ***F21Y 115/10*** | (2016.01) |

(52) U.S. Cl.
CPC *F21S 4/28* (2016.01); *F21K 9/90* (2013.01); *F21V 23/001* (2013.01); *F21V 23/06* (2013.01); *F21Y 2103/10* (2016.08); *F21Y 2115/10* (2016.08)

(58) Field of Classification Search
CPC ..... F21S 4/28; F21V 23/06; F21V 23/001; H01R 12/58
See application file for complete search history.

(56) References Cited

U.S. PATENT DOCUMENTS

| | | | | |
|---|---|---|---|---|
| 10,801,716 | B1 | 10/2020 | Lopez-Martinez et al. | |
| 11,168,852 | B1 * | 11/2021 | Irons | F21V 3/10 |
| 11,199,300 | B1 * | 12/2021 | Irons | F21V 3/10 |
| 2015/0369459 | A1 * | 12/2015 | Huang | F21V 17/101 29/832 |
| 2017/0138578 | A1 * | 5/2017 | Pearson | F21V 23/06 |
| 2017/0292664 | A1 * | 10/2017 | Pearson | F21V 29/508 |
| 2018/0031189 | A1 * | 2/2018 | Pearson | F21V 3/02 |
| 2019/0003666 | A1 * | 1/2019 | Pearson | F21V 21/025 |
| 2020/0041103 | A1 * | 2/2020 | Germain | F21S 2/00 |

OTHER PUBLICATIONS

U.S. Appl. No. 17/130,935, filed Dec. 22, 2020, Irons, et al.
U.S. Appl. No. 17/412,951, filed Aug. 26, 2021, McKay.

* cited by examiner

*Primary Examiner* — William N Harris
(74) *Attorney, Agent, or Firm* — United IP Counselors, LLC

(57) ABSTRACT

The disclosure relates to methods for connecting encapsulated linear lighting to power, including the use of through-hole mounting into flexible encapsulated linear lighting, and the creation of overmolds to protect electrical connections. The disclosure also relates to linear luminaires having channels that accommodate overmolds and allow electrical cables to exit the encapsulated linear lighting in desired, and controllable, directions.

15 Claims, 9 Drawing Sheets

ENCAPSULATED LINEAR LIGHTING WITH CHANNEL

TECHNICAL FIELD

The invention relates to linear lighting and to channels for linear lighting.

BACKGROUND

Linear lighting is a class of solid-state lighting in which light-emitting diode (LED) light engines are mounted on an elongate, narrow printed circuit board (PCB), spaced at some regular spacing or pitch. The PCB may be flexible or rigid. Connected to an appropriate power supply, linear lighting may serve as a luminaire in its own right, and is often used as a raw material in the construction of more complex luminaires.

It's become common to encapsulate linear lighting within a polymeric covering. This kind of encapsulation protects the linear lighting from the elements. In some cases, the encapsulation may have additional functions as well, such as diffusing the emitted light.

One issue with encapsulated linear lighting is connecting it to power. Typically, a strip of encapsulated linear lighting is connected to power by soldering conductors from a cable to solder pads defined on the PCB. For example, in FIG. 1 of U.S. Pat. No. 10,801,716, the contents of which are incorporated by reference herein in their entirety, a cable is shown entering the encapsulation of a strip of linear lighting at one end. Wires from the cable are soldered to solder pads on the PCB. As shown in the figure, a power cable usually extends at least a few millimeters into the encapsulation; this penetration distance ensures that the encapsulation will not leak around the cable, and provides some degree of strain relief to the cable.

There are several difficulties with this sort of cable penetration. First, it is usually desirable to make an encapsulated strip of linear lighting as small as possible in all dimensions. However, with the traditional arrangement, one must make the encapsulation, or at least a portion of it, as large as the power and data cable that extends into the encapsulation. This is especially cumbersome when the cable is large—and safety regulations may require a large, heavily-jacketed cable in many scenarios, including situations in which the encapsulated linear lighting is to be fully immersed in water.

Additionally, it is not always convenient for a cable to protrude from one end of an encapsulated strip of linear lighting. There are certain cases in which it would be of great benefit for a cable to be connected elsewhere on a strip of linear lighting. However, robust techniques for attaching a cable elsewhere have not been developed.

BRIEF SUMMARY

One aspect of the invention relates to a linear luminaire. The linear luminaire comprises a channel with a pair of generally vertical sidewalls connected together and spaced apart by a web, defining an upper compartment and a lower compartment. The web has one or more slots therein. At least one piece of encapsulated linear lighting is positioned in the upper compartment of the channel. The encapsulated linear lighting has an overmold that extends through one of the one or more slots in the web, into the lower compartment when the linear lighting is in the upper compartment. A cable extends out of the overmold and extends along the lower compartment in a direction parallel to a length of the linear lighting.

In some embodiments, a second piece of encapsulated linear lighting may be positioned in the upper compartment of the channel abutting an end of the first piece of linear lighting so as to create the appearance of a continuous line of light when the two pieces of encapsulated linear lighting are lit. The second piece of encapsulated linear lighting also extends through one of the one or more slots in the web. A cable extends out of that overmold and extends along the lower compartment as well. Thus, the lower compartment of the channel serves as a cableway, with the slots in the web allowing the overmolds and cables to extend into the lower compartment while the pieces of encapsulated linear lighting sit flat and flush in the upper compartments of the channel.

Another aspect of the invention relates to methods for creating a strip of encapsulated linear lighting with an overmolded cable. In these methods, a strip of linear lighting is laid in a channel. Electrical connections are made to solder pads on the strip of linear lighting, such that a cable extends out of the linear lighting. The channel is filled with a resin to create a covering or encapsulation. The cable is overmolded. In some embodiments, the channel may be filled in a first orientation, and the overmold may be created by placing the channel in a second orientation in a mold to create the overmold. Depending on the embodiment, the electrical connections may be made by through-hole mounting an electrical connector through aligned holes in the PCB and channel, connecting wires to the connector, and overmolding the connection. The overmold may be positioned below the main extent of the channel in some embodiments.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
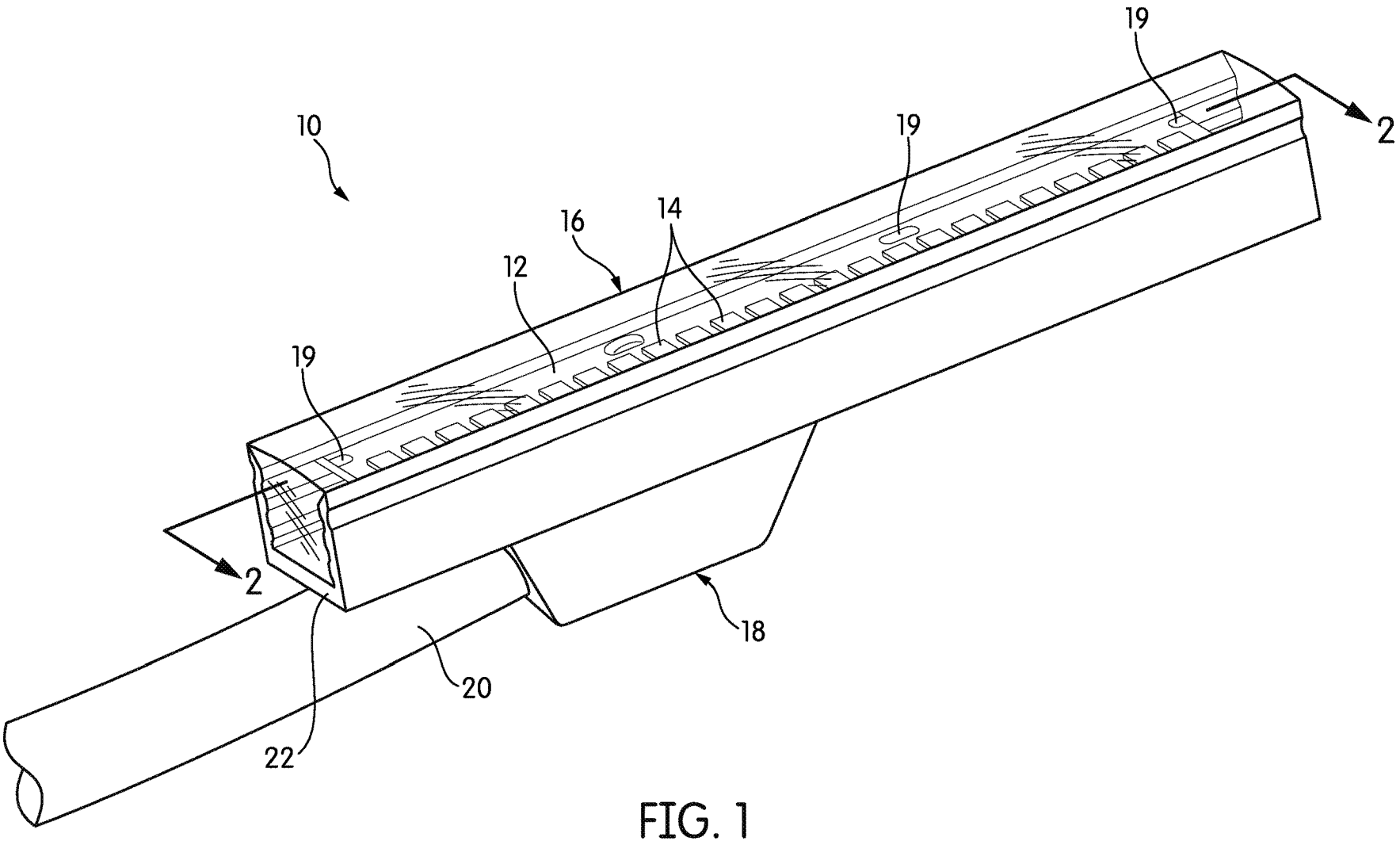
FIG. 1 is a perspective view of an encapsulated strip of linear lighting according to one embodiment of the invention.

FIG. 1 is a perspective view of a strip of encapsulated linear lighting, generally indicated at 10, according to one embodiment of the invention. The strip of encapsulated linear lighting 10 comprises a printed circuit board (PCB) 12 with a number of LED light engines 14 surface-mounted on the PCB 12. The PCB 12 with its LED light engines 14 is encapsulated within a covering 16. As will be described below in more detail, at the bottom of the covering 16, an overmold 18 extends from the covering 16. A cable 20 protrudes from the overmold 18. In the illustrated embodiment, the cable 20 extends parallel to and below the extent of the PCB 12.

The PCB 12 and LED light engines 14 may be of any type. As used here, the term "LED light engines" refers to one or more LEDs in a package that includes all connections necessary to be mounted on a printed circuit board. Some LED light engines 14, in particular those intended to emit so-called "white" light, may be topped with a phosphor, a chemical mixture that absorbs the light emitted by the LEDs and re-emits a different spectrum of light wavelengths. In other cases, the LED light engines 14 may be RGB light engines, i.e., those that include red, green, and blue LEDs and can produce a range of colors by additive color mixing. The form of the LED light engines 14 may vary from embodiment to embodiment, they may be more or less numerous than illustrated in FIG. 1, and they may be spaced at whatever pitch is desired. The exact nature of the PCB 12 and LED light engines 14 is not critical and may vary considerably from embodiment to embodiment. In fact, recent forms of LED light engine may not use the familiar types of package, nor may each package be covered with a single dot of phosphor. More recent forms of linear lighting may use a continuous stripe or line of phosphor that covers a number of light-emitting elements. Thus, for purposes of this description, the term "LED light engine" should be read to mean any solid-state element that emits light. The exact nature of that element is not critical to the invention.

The PCB 12 may be flexible or rigid. Flexible PCB is typically made with a material such as MYLAR® biaxially-oriented polyethylene terephthalate. Rigid PCB may be made of a metal, such as aluminum, a ceramic, or a composite material, such as FR4. Flexible PCB may be backed with a layer of pressure-sensitive adhesive, in which case it is commonly referred to in the industry as "tape light."

In the illustration of FIG. 1, the section of PCB 12 that is shown has only LED light engines 14 mounted on it. Typically, the PCB 12 would have at least some other components. For example, in order to form a complete lighting circuit, some elements are needed to set the level of current in the circuit. This may be done in the power supply for the linear lighting 10, in which case the linear lighting 10 may be referred to as "constant current" linear lighting. However, a component or components may be mounted on the PCB 12 to set the current in the circuit, in which case the linear lighting 10 may be referred to as "constant voltage" linear lighting. The component or components mounted on the PCB 10 for current control may be a resistor or resistors, although in some cases, current-control integrated circuits (ICs) may be used. In some cases, more sophisticated components may be included on the PCB 12 for various purposes, including raising or lowering the applied voltage, converting from alternating current (AC) to direct current (DC), or controlling RGB LED light engines 14.

The covering 16 in its finished form is solid and completely encapsulates the PCB 12. However, the covering 16 is typically made in several steps with individual components. Generally speaking, the covering 16 is made according to the steps outlined in U.S. Pat. No. 10,801,716, which was incorporated by reference above. Typically, the PCB 12 is placed in a channel 22, e.g., by securing its pressure-sensitive adhesive layer to the bottom of the channel 22 and then filling the channel 22 with a resin. In order to fill the channel 22 with resin, the ends are dammed in some manner. In some embodiments, endcaps may be glued, fused, or otherwise permanently secured at the ends of the channel 22. However, in other embodiments, removable stoppers may be used to temporarily dam the ends of the channel 22. When the encapsulation process is complete, the channel 22 may or may not be easily distinguishable from the resin that fills it. In many cases, the channel 22 is made of a reflective white or white-ceramic resin, such that the channel 22 is distinguishable from the resin when the covering 16 is complete; however, the channel 22 may be made of the same type and color of resin that is used to fill it.

The PCB 12 usually has a two-layer construction, with the LED light engines 14 on the upper layer and a patterned conductive layer as the lower layer. PCB 12 for linear lighting is usually laid out in repeating blocks, divided by cut points. A repeating block is a complete lighting circuit; connected to power, it will light. The cut points are the points at which one repeating block may be cut or otherwise separated from another without damaging either repeating block. Cut points may be marked on the upper surface of the PCB 12, e.g., by screen printing, or they may be deduced using landmarks on the PCB 12. As shown, the PCB 12 includes sets of solder pads 19. Physically, the solder pads 19 are areas where the insulator of the upper layer of the PCB 12 is removed to expose the conductor on the lower layer. The solder pads 19 serve as electrical connection points, and while soldering is one way in which connections may be made to the solder pads 19, in some cases, solder pads 19 may also accept connections from electrical connectors. The number and position of the solder pads 19 may vary from embodiment to embodiment, depending on the number of inputs that the LED light engines 14 require in order to operate. In the illustrated embodiment, the LED light engines 14 are lined up in a row in the center of the PCB 12 while the solder pads 19 extend to either side of the LED light engines 14.

Figure 2:
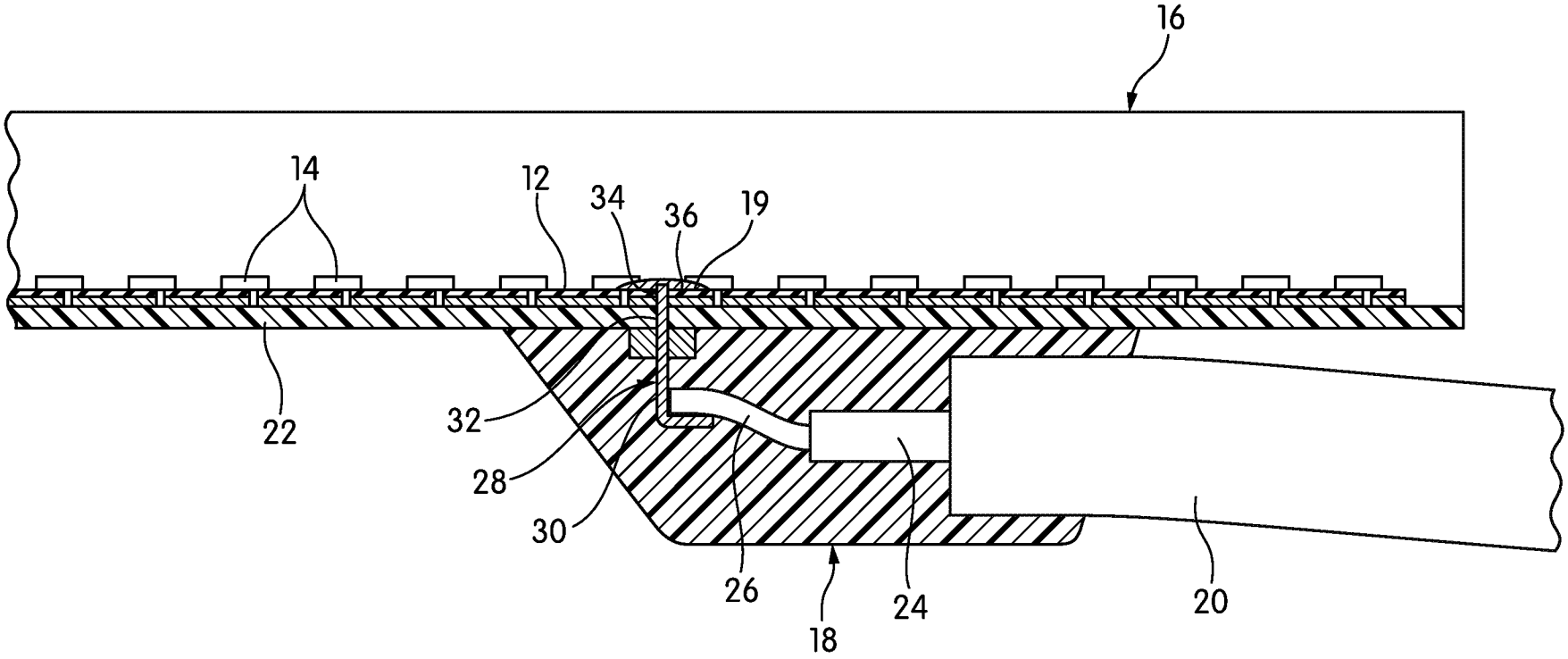
FIG. 2 is a cross-sectional view taken through Line 2-2 of FIG. 1.

One unique feature of the illustrated encapsulated linear lighting 10 is the way in which it is connected to power. That is illustrated in more detail in the cross-sectional view of FIG. 2, which is taken through Line 2-2 of FIG. 1. Several things about the connection are different. As shown, a cable 20 has one or more wires 24, each of which includes a solid or stranded conductor 26. In many cases, the cable 20 would enter the encapsulated linear lighting 10 and its conductors 26 would be soldered to solder pads 19 on the top of the PCB 12, that is not the case in FIG. 2. In FIG. 2, a pin connector 28 with one or more pins 30 is used. The pins 30 of the pin connector 28 are through-hole mounted in aligned holes 32, 34 punched in the bottom of the channel 22 and in the solder pads 19 of the PCB 12 itself. The through-hole-mounted pins 30 are secured with solder 36 on the upper surface of the PCB 12. This is something of a departure from normal practice, insofar as the PCBs 12 for linear lighting are not typically designed for through-hole mounting. In order to mount the pins 30, holes (e.g., 1-1.5 mm holes) are punched in the PCB 12. The mounting is such that the pins 30 are not visible from the upper side of the PCB 12, as they are completely enveloped by solder 36. That need not be the case in all embodiments.

As shown, the pins 30 make a 90° turn after exiting the covering 16 to extend parallel to the PCB 12. In this embodiment, the conductors 26 are soldered to the other ends of the pins 30. However, other connectors may use other arrangements, including terminal blocks for securing conductors 26.

This is not the only connection arrangement that can be used. For example, through-holes may be provided or formed in other areas of the PCB 12, and the conductors 26 and/or wires 24 may be routed through the through-holes and soldered to the solder pads 19 on the upper side of the PCB 12. In some cases, the conductors 26 and/or wires 24 may traverse some length of the PCB 12.

The advantage of the arrangement shown in FIGS. 1 and 2 is that power can enter the covering 16 from virtually anywhere along the PCB 12, and the cable 20 can extend in virtually any direction. For example, while the cable 20 extends parallel to the PCB 12 in FIGS. 1 and 2, in other embodiments, the connector pins 30 may extend straight, such that the cable 20 extends out of the overmold 18 perpendicular to the PCB 12.

In the description above, the term "cable" is used to describe the structure that conveys power and/or signals into the encapsulated linear lighting 10. The term "cable" usually denotes one or more wires or other types of conductors with an outer jacketing. Some forms of cable may also include electromagnetic shielding or other features. While a cable 20 according to embodiments of the invention may have any or all of these features, the term "cable" in this description should be read broadly to include any types of conductors that provide power and/or signals. For example, the term "cable" should be read to include an unjacketed assemblage of wires.

Figure 3:
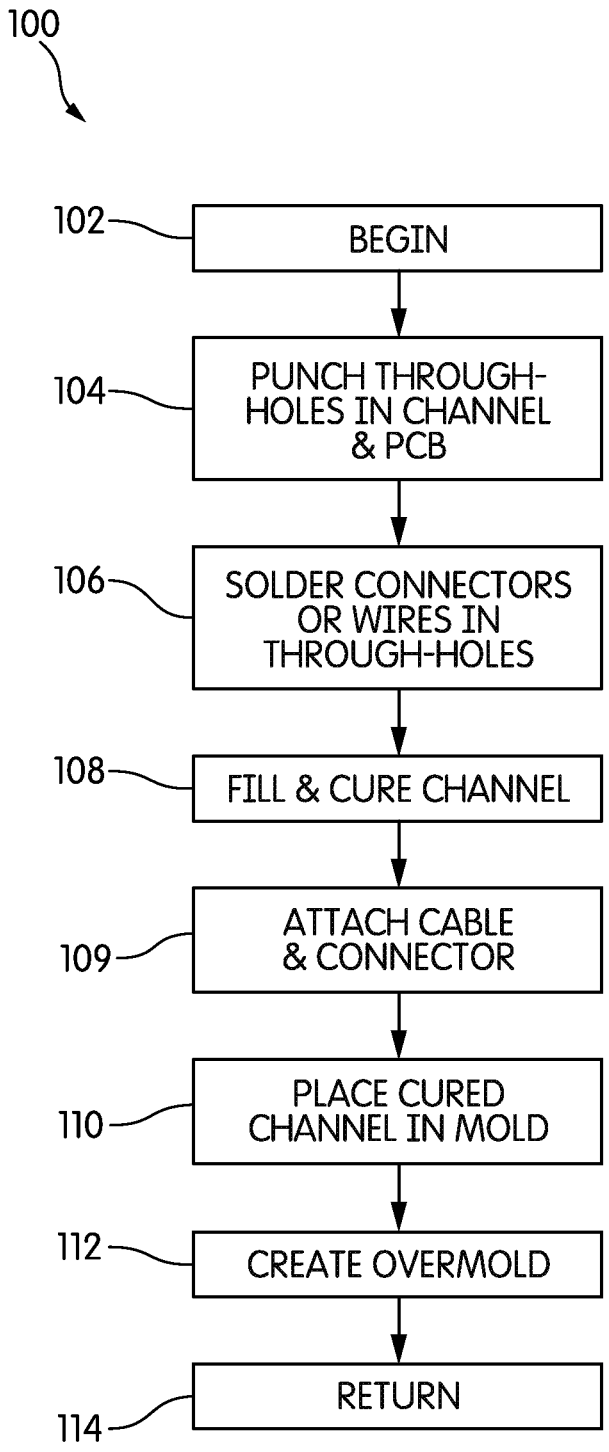
FIG. 3 is a schematic flow diagram of a method for manufacturing the encapsulated strip of linear lighting of FIGS. 1 and 2.

There are several tasks involved in creating an overmold 18, and these are illustrated in FIG. 3, a flow diagram of method 100. Method 100 begins at task 102 and continues with task 104. As method 100 begins, a PCB 12 has been laid down in a channel 22, as described above and in U.S. Pat. No. 10,801,716. In task 104, aligned through-holes 32, 34 are punched in the channel 22 and through the PCB 12 at the positions of one set of solder pads 19. Once the through-holes 32, 34 are punched, a connector 28 is inserted into the through-holes 32, 34 and soldered in place.

In some cases, conductors 26 from wires 24 may be inserted directly into the through-holes 32, 34 and soldered in place, such that a connector 28 is unnecessary and is thus omitted. If the conductors 26 are stranded wire, they may be tinned to assist with insertion. Direct connection of the conductors 26 to the PCB 12 has the advantage of using one fewer part in making the connection, although doing so may require cable management during the channel-filling process. On the other hand, the advantage of a connector 28 is that its pins 30 presumably have the correct dimensions to be inserted in the through-holes 32, 34, while the conductors 26 of the cable 20 may be of any thicknesses or other dimensions. Therefore, the use of a connector 28 may allow the use of thicker conductors 26 and wires of greater ampacity, irrespective of the dimensions necessary to connect to the PCB 12. A connector 28 may be particularly helpful, for example, when the encapsulated linear lighting 10 is intended to have a high ingress protection rating and may spend considerable amounts of time underwater or in other difficult environments. In these cases, the cable 20 may be required by applicable safety regulations to use heavy-gauge conductors 26 and to have particularly thick jacketing.

Figure 4:
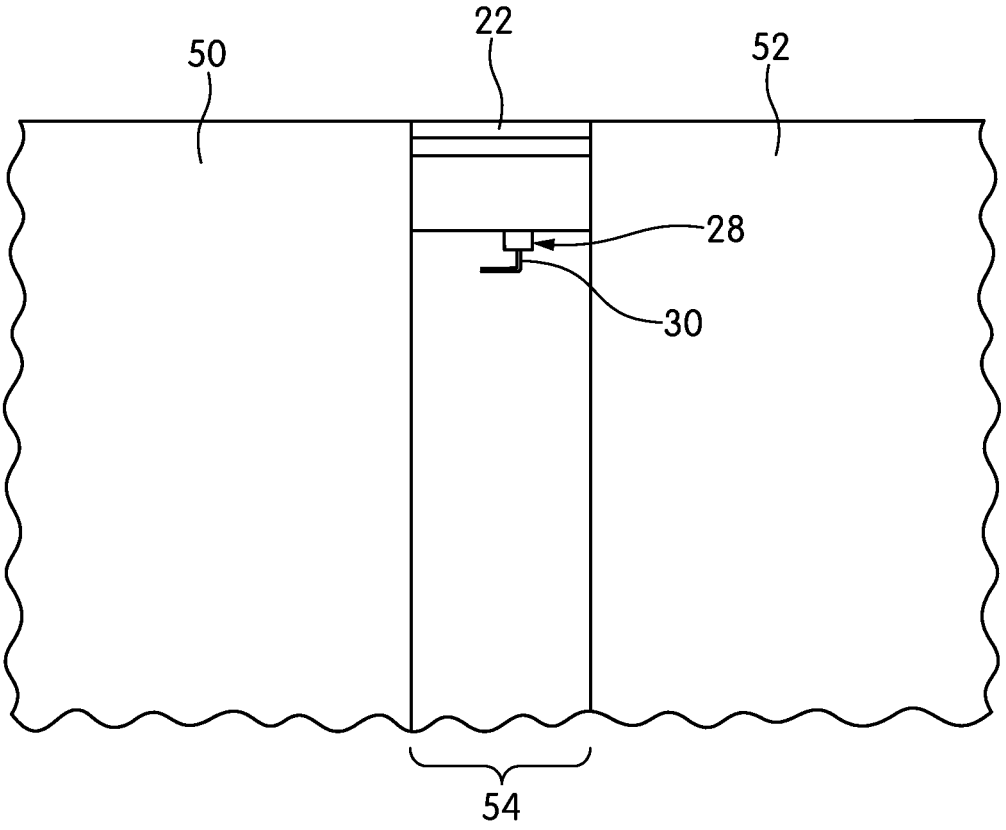
FIG. 4 is a side elevational view of the channel of the encapsulated strip of linear lighting suspended from two carriers with an unsupported portion including an electrical connector during a portion of the method for manufacturing of FIG. 3.

Method 100 continues with task 108, the manufacturing process proceeds much as normal, and the channel 22 is filled with resin. There is only one change in the typical process at this point: structures are used to support the channel 22 around the connector 28, which is protruding from the bottom of the channel 22. One way of doing this is shown in FIG. 4, a side elevational view of the channel 22 during task 108 of method 100. When a channel 22 is to be filled in a typical process, it is placed in a carrier, which supports the channel 22 during the filling process. In FIG. 3, there are two adjacent carriers 50, 52. The two adjacent carriers 50, 52 are aligned to support the channel 22, but they define a small gap 54 between them at the location where the connector 28 protrudes out of the channel 22. That gap 54 is typically as small as possible, e.g., 5-10 mm, in order to ensure that the channel 22 remains supported and will not sag significantly in the gap 54.

Figure 8:
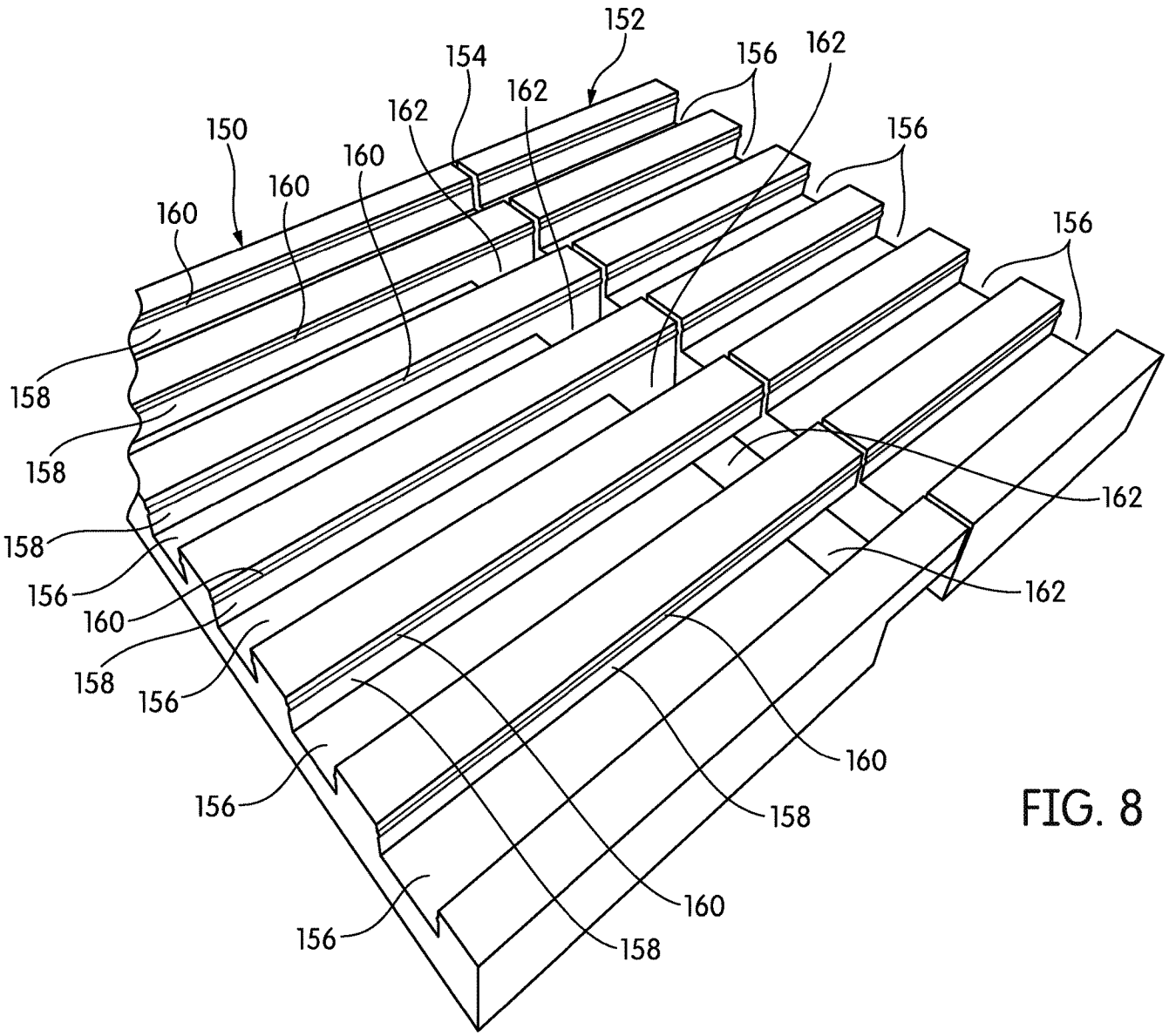
FIG. 8 is a perspective view of a support or carrier that may be used to hold channel during the manufacture of the encapsulated strip of linear lighting.

In some cases, the two adjacent carriers 50, 52 may provide adequate support for the channel 22 as it fills. However, it is possible that without side support, the channel 22 may bulge outward as it fills. For that reason, it is possible to use carriers that provide side support but have an opening in the bottom. FIG. 8 is a perspective view illustrating this concept.

FIG. 8 illustrates a first carrier 150 and a second carrier 152 that are spaced apart from each other by a small gap 154. The gap 154 is provided because the two carriers 150, 152 of this embodiment are constructed of silicone or another elastomeric material with a relatively high coefficient of thermal expansion; the gap 154 provides room for expansion when the carriers 150, 152 are heated in a curing oven. This prevents the expanding carriers 150, 152 from inducing longitudinal stresses in the channels 22.

In the illustrated embodiment, each carrier 150, 152 is designed to simultaneously carry and support up to six separate segments of channel 22 during the filling and curing process. Each carrier 150, 152 defines six slots 156 in which to do so. In this embodiment, the sidewalls 158 of the slots 156 have features, such as a protruding line 160, complementary to those of the channel 22.

Figure 9:
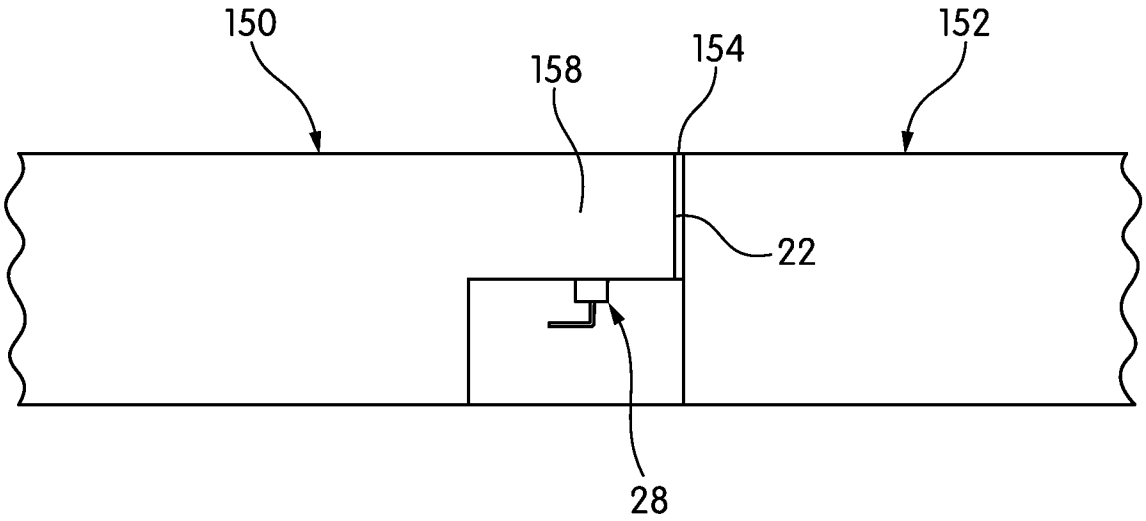
FIG. 9 is a side elevational view of a channel held in the support or carrier of FIG. 8.

The first carrier 150 is designed to accommodate the connector 28 and is thus different from the second carrier 152. Specifically, each slot 156 in the first carrier 150 has an opening 160 that goes through the bottom of the carrier 150. In the area around the opening 160, the slot 156 has sidewalls 158 but no bottom. FIG. 9 is a side elevational view of the two carriers 150, 152 with a channel 22 installed. As shown in the side-elevational view of FIG. 9, the openings 160 allow the connector 28 to protrude out below the channel 22. In this way, the channel 22 is level within the slot 156 in the first carrier 150, and also has side support from the sidewalls 158, even in the area around the opening 160. Thus, the channel 22 is supported as much as possible while the connector 28 is accommodated. Of course, the opening 160 need not be an opening in all embodiments. Rather than an opening, a recess deep enough to accommodate the connector 28 could be used.

As with other instances in which a channel 22 is filled, it may proceed in several stages, and the channel 22 may be "dosed" with resin in several layers. For example, a thin layer of resin may be deposited around and over the LED light engines 14 and cured, and then a thicker layer or layers of resin may be deposited and cured. Alternatively, the channel 22 may be filled and cured with a single dosing of resin. The advantage of using several layers of resin is that it may be easier to eliminate air bubbles, although doing so generally takes more time.

Once the channel 22 is filled and cured, method 100 continues with task 109 and the cable 20 is attached to the connector 28. While the electrical connections between the connector 28 and the PCB 12 may be tested after task 106, the cable 20 is not usually attached prior to filling in task 108 because doing so might require a long length of cable 20 to be accommodated on the working bed of a machine that has limited space. While exceptions may be made, it is usually easier to attach the cable 20 to the connector 28 once the filling and curing operations are complete. Thus, in task 109, wires 24 and their conductors 26 are connected to the pins 30 of the connector 28. Typically, this would also be done by soldering, although crimps, press-fit arrangements, and other means of electrical and mechanical connection may be used. Because of the support offered by the overmold 18, the manner of connection may not need to support a significant amount of weight.

Method 100 continues with task 110. In task 110, the filled, cured channel 22 with connected wires 24 and cable 20 is placed in a mold for overmolding. As those of skill in the art will appreciate, the overmold 18 shown in FIGS. 1 and 2 protects the connection between the connector 28 and the wires 24 and provides strain relief for the cable 20. The overmold 18 can be produced by traditional injection molding with a high-pressure, relatively high-temperature process.

Although injection molding can be used to produce the overmold 18, the present inventors have found that the overmold 18 can advantageously be produced by the same low-pressure liquid resin techniques that are used to fill the channel 22 to create the covering 16. The present inventors have also discovered that if the overmold 18 is produced by the kind of low-pressure liquid resin techniques described above, it is advantageous if this is done in an accessible way.

It would be possible, for example, to place the channel 22 in a one-piece (i.e., open) or two-piece mold in the same orientation as shown in FIG. 4, i.e., with the connector 28 and cable 20 extending vertically below the channel 22. Resin can then be injected into that mold. However, this orientation may be more difficult to work in, and when working with liquid resin, there is a greater chance of air bubbles.

Figure 5:
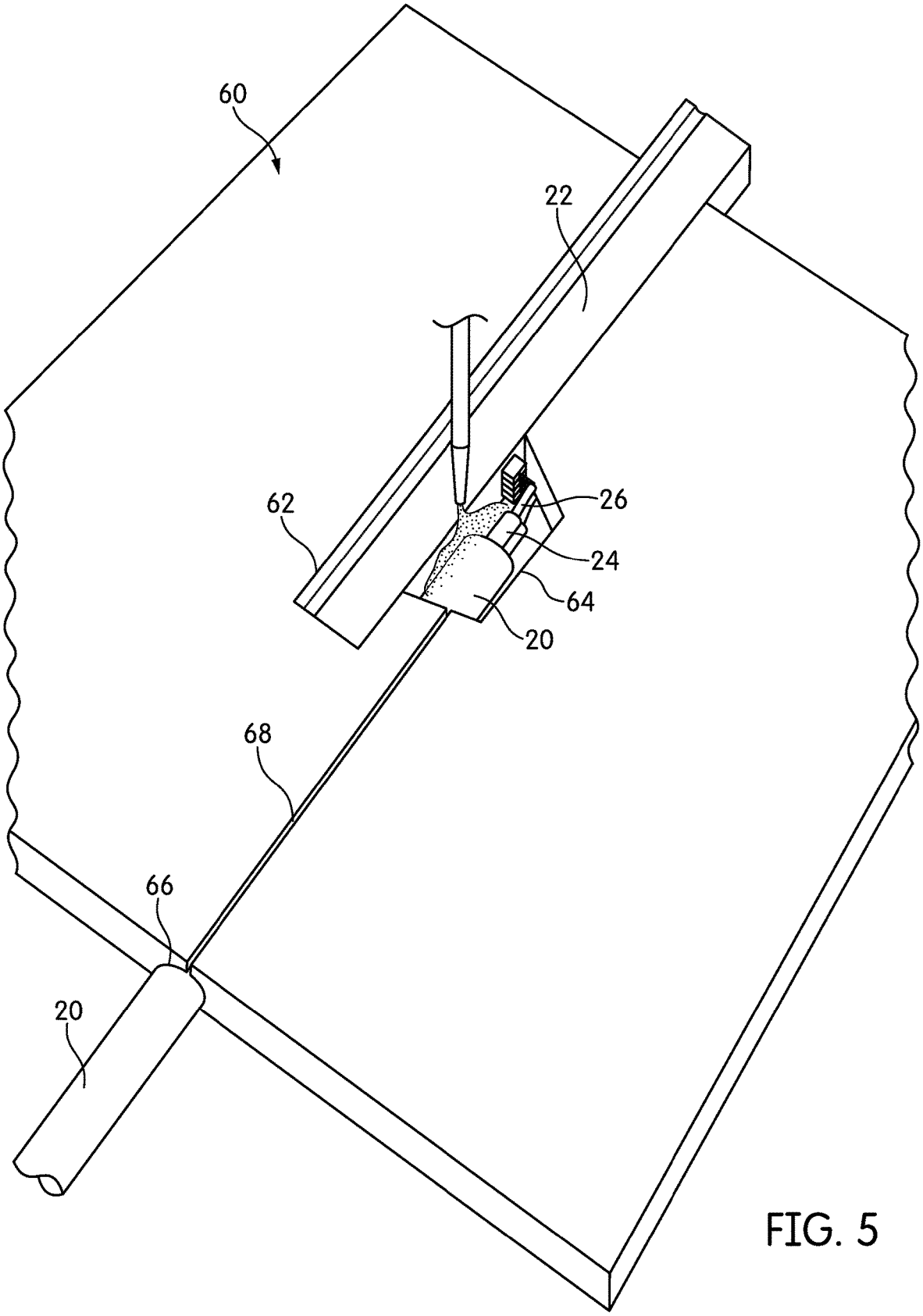
FIG. 5 is a top perspective view of the encapsulated strip of linear lighting positioned in a mold for creation of an overmold of the connection of the strip with an electrical cable.

FIG. 5, a perspective view, shows an alternative way to create the overmold 18. The filled channel 22 is flipped 90° and placed on its side into a mold 60 with a first mold cavity 62 for the channel 22 and a second mold cavity 64 for the overmold 64. The second mold cavity 64 is connected to a channel 66 for the cable 20. Both cavities 62, 64 are open, i.e., there is no second mold part that closes the mold. The channel 68 has a break in the upper face of the mold 60, so that the cable 20 can be pressed into it, instead of having to be fed into the channel 66 from one end. As with the carriers 50, 52, if the resin is polyurethane, the mold 60 would typically be constructed of a silicone polymer. Similarly, if the resin is silicone, the mold 60 would typically be polyurethane or some other polymer that will not bind to the silicone. More generally, because the overmolding operation is done without applied pressure and relies on the low viscosity of the resin to fill the space, there is no need for the mold 60 to be rigid, and a cast or machined polymer will suffice; the key features of any mold 60 are fidelity to the desired shapes and dimensions and a material or coating that will not bind with the resin. Method 100 continues with task 112, and the overmold 18 is created by filling the second mold cavity 64 with resin, as shown in FIG. 5. By performing the main filling tasks with the channel 22 in a first orientation and the overmold with the channel 22 in a second orientation, both tasks can be performed with relative ease. Method 100 returns at task 114.

Method 100 and FIGS. 1-5, 8, and 9 present particular examples of a method and a strip of encapsulated linear lighting according to an embodiment of the invention. These are not the only way in which embodiments of the invention may be implemented. For example, although through-hole mounting is one convenient way to connect wires to the PCB 12 of a strip of encapsulated linear lighting, that is not the only way that connection may be accomplished. A strip of encapsulated linear lighting according to another embodiment may have an overmold, either similar to the overmold 18 described above or different. From the overmold, wires 24 with conductors 26 may enter the covering 16 and be soldered to the solder pads 19 without through-hole mounting. In other words, an overmold 18 may be used with a variety of different ways of connecting the PCB 12 to power.

The ability to manage the entry and exit of power cables in encapsulated linear lighting 10 may allow for more flexibility in how linear lighting 10 can be used. Ultimately, creative placement of an overmold and thoughtful consideration of where and how a cable 20 should exit encapsulated linear lighting may help to overcome a number of practical limitations, including limitations on maximum length. All linear lighting has some limit to its length, whether that limit is electrical (e.g., the maximum length of linear lighting that can be effectively lit if supplied with power from a single point) or a functional limit on the maximum length of linear lighting that can be manufactured in a particular process. However, in applications of linear lighting, it is often desirable for linear lighting to span a length greater than the maximum length that it is possible to make any one strip of linear lighting. If issues of cable-exit are handled creatively, it may allow a designer to at least seemingly overcome some of these issues.

Figure 6:
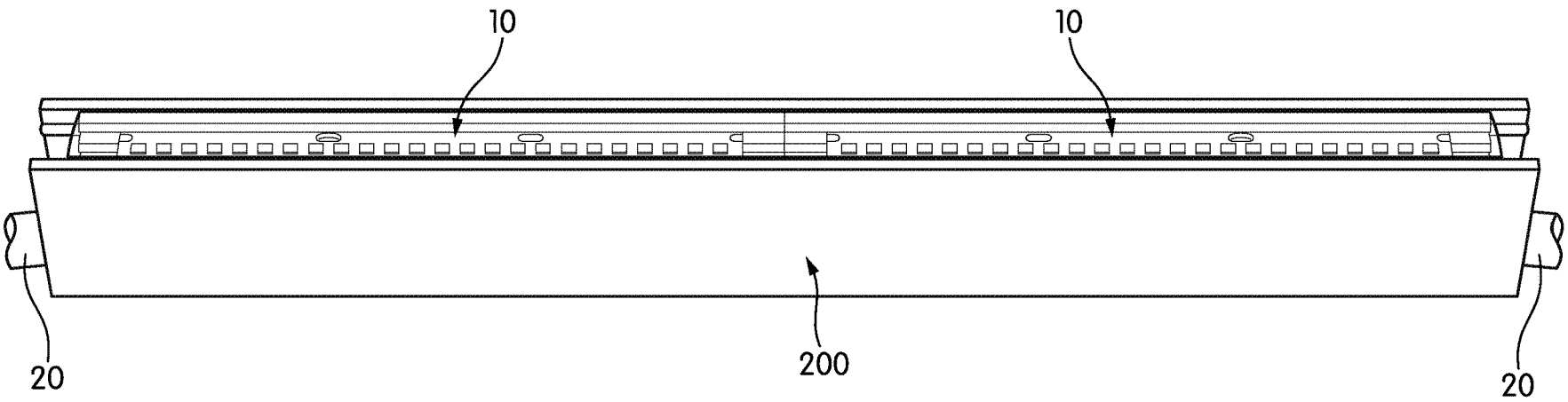
FIG. 6 is a perspective view of two encapsulated strips of linear lighting positioned end-to-end in a channel.
Figure 7:
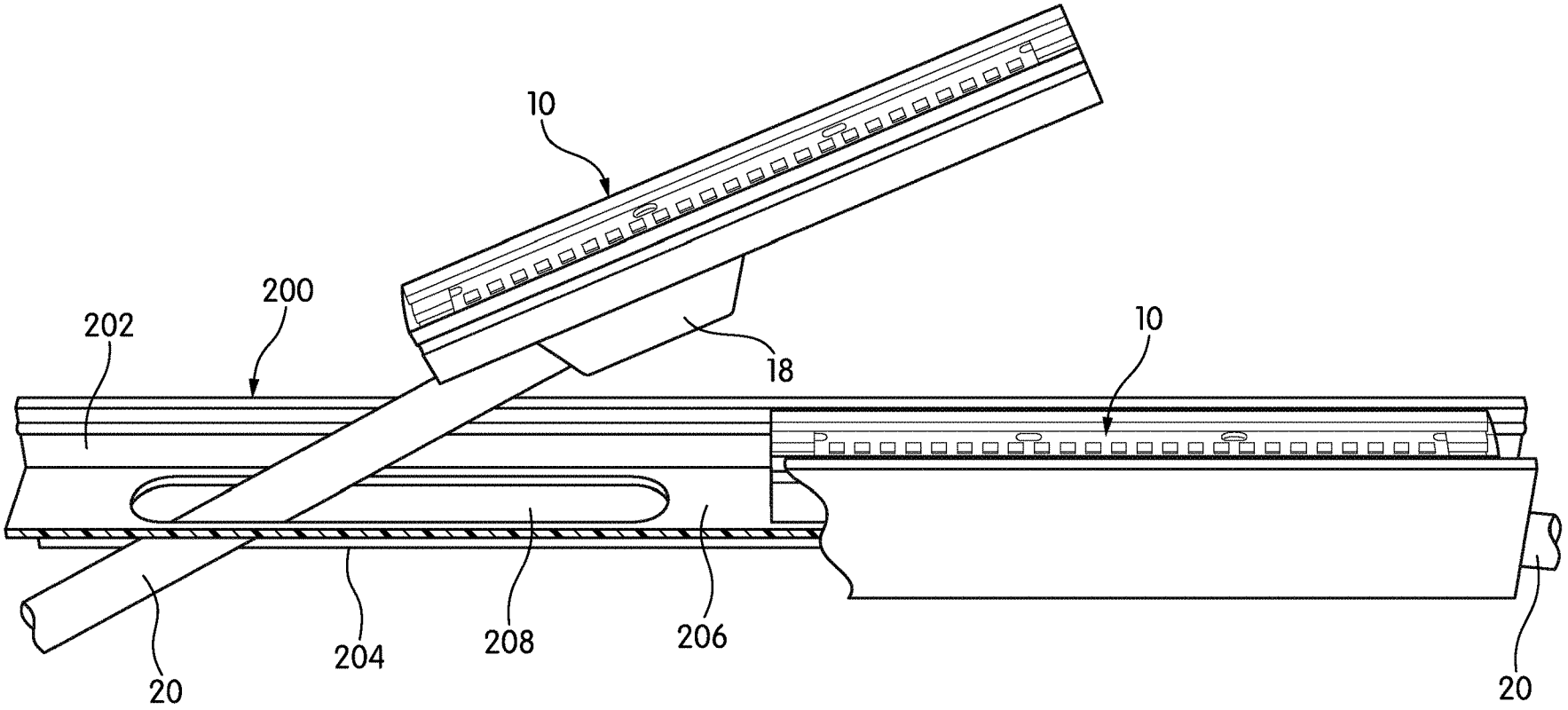
FIG. 7 is a partially cut-away perspective view of the channel of FIG. 6, illustrating the position of the overmold and exit of the cable.

FIG. 6 is a perspective view illustrating one way of creating an uninterrupted line of light using two pieces of encapsulated linear lighting 10 to form a linear luminaire. The two pieces of encapsulated linear lighting 10 are abutted end-to-end and rest within a channel 200. As can be seen in FIG. 7, a cut-away perspective view of the channel 200 and linear lighting 10, the channel 200 has a pair of generally vertical sidewalls that define an upper compartment 202 and a lower compartment 204. A web 206 serves as a divider between the upper compartment 202 and the lower compartment 204 and extends generally horizontally between the sidewalls of the channel 200, giving the channel 200 an H-shaped cross-section.

FIG. 7 shows that the web 206 between the upper and lower compartments 202, 204 has a large slot 208 with rounded ends extending longitudinally along its centerline. The slot 208 has enough width to accommodate the cable 20 and the overmold 18 from a piece of encapsulated linear lighting 10. Only one side of the interior of the channel 200 is shown in FIG. 7, although the structure may be assumed to be the same on the obscured side.

The effect of the structure shown in FIG. 7 is that each strip of encapsulated linear lighting 10 can sit flat on the web 206 within the upper compartment 202 while its overmold 18 extends into the lower compartment 204 and its cable 20 extends longitudinally along the lower compartment 204 of the channel 200. With their ends abutted, two strips of encapsulated linear lighting 10 thus produce a continuous-appearing line of light, while their power or power and data cables 20 exit inconspicuously. Moreover, because the two cables 20 exit through the bottom compartment, it may not be necessary to provide extra space at the ends of the channel 200 for the data cables 20.

Although FIGS. 6 and 7 illustrate the use of the channel 200 with two strips of encapsulated linear lighting, a channel 200 need not contain two strips of encapsulated linear lighting 10 to be useful. A channel 200 may be used with a single strip of encapsulated linear lighting.

The overmold 18 shown in the figures lies below the main extent of the channel 22. However, that orientation may differ from embodiment to embodiment. An electrical connector or wires may enter a strip of encapsulated linear lighting from the top or a side, and an overmold may be formed along those aspects of the channel 22 as well. The location of the overmold and the manner in which a connector or conductors enter the covering 16 will depend on the overall application for the encapsulated linear lighting and where space exists for the overmold. The advantage of the channel 200 is that it creates space for the overmold 18 below the main extent of the encapsulated linear lighting 10.

While the invention has been described with respect to certain embodiments, the description is intended to be exemplary, rather than limiting. Modifications and changes may be made within the scope of the invention, which is defined by the appended claims.

What is claimed is:

1. A linear luminaire, comprising:

a channel having a pair of generally vertical sidewalls connected together and spaced apart by a web that separates the channel into an upper compartment and a lower compartment, the web having one or more slots therein; and a first strip of encapsulated linear lighting having a printed circuit board (PCB) with LED light engines disposed thereon, a covering encapsulating the PCB, a cable connected to the first strip of encapsulated linear lighting, and an overmold over a first portion of the cable proximate to the covering;

wherein the first strip of encapsulated linear lighting is positioned in the channel such that the overmold extends through one of the one or more slots in the web of the channel.

2. The linear luminaire of claim 1, wherein the cable extends in a direction generally parallel to a length of the first strip of encapsulated linear lighting along the lower compartment of the channel.

3. The linear luminaire of claim 2, further comprising a second strip of encapsulated linear lighting having a second PCB with second LED light engines disposed thereon, a second covering encapsulating the second PCB, and a second cable connected to the second strip of encapsulated linear lighting, with a second overmold over a first portion of the second cable proximate to the second covering;

wherein the second strip of encapsulated linear lighting is positioned in the channel abutting a free end of the first strip of encapsulated linear lighting, such that the second overmold extends through one of the one or more slots in the web of the channel.

4. The linear luminaire of claim 3, wherein the second cable extends in a direction generally parallel to a length of the second strip of encapsulated linear lighting along the lower compartment of the channel.

5. The linear luminaire of claim 3, wherein the second overmold extends below the second strip of encapsulated linear lighting.

6. The linear luminaire of claim 5, wherein one or more wires from the second cable are through-hole mounted in the second PCB.

7. The linear luminaire of claim 5, further comprising a connector having one or more pins through-hole mounted in the second PCB;

wherein one or more wires of the second cable are electrically connected to the connector and the overmold surrounds the connector and the one or more wires that are electrically connected to the connector.

8. The linear luminaire of claim 2, wherein the overmold extends below the first strip of encapsulated linear lighting.

9. The linear luminaire of claim 8, wherein one or more wires from the cable are through-hole mounted in the PCB.

10. The linear luminaire of claim 8, further comprising a connector having one or more pins through-hole mounted in the PCB;

wherein one or more wires of the cable are electrically connected to the connector and the overmold surrounds the connector and the one or more wires that are electrically connected to the connector.

11. A method of manufacturing a strip of encapsulated linear lighting, comprising:

laying a strip of linear lighting in a channel, the strip of linear lighting including a printed circuit board (PCB) with one or more LED light engines disposed thereon and one or more solder pads defined in a conductive layer of the PCB;

punching aligned through-holes in the channel and the PCB, the holes in the PCB extending through a set of the one or more solder pads;

mounting electrical conductors in the through-holes;

filling the channel with a resin to create a coating over the strip of linear lighting; and overmolding around the electrical conductors.

12. The method of claim 11, wherein the electrical conductors comprise an electrical connector and the method further comprises:

connecting the electrical connector to wires from a cable;

wherein the electrical connector, the wires, and a portion of the cable are overmolded during said overmolding.

13. The method of claim 11, wherein said filling is done with the channel in a first orientation and said overmolding is done with the channel in a second orientation.

14. A method, comprising:

laying a strip of linear lighting in a channel, the strip of linear lighting including a printed circuit board (PCB) with one or more LED light engines disposed thereon and one or more solder pads defined in a conductive layer of the PCB;

connecting electrical conductors to a set of the one or more solder pads;

filling the channel with a resin to create a coating over the strip of linear lighting; and overmolding around the electrical conductors.

15. The method of claim 14, wherein said filling is done with the channel in a first orientation and said overmolding is done with the channel in a second orientation.

* * * * *